US007056273B2

(12) United States Patent
Ostkamp et al.

(10) Patent No.: US 7,056,273 B2
(45) Date of Patent: Jun. 6, 2006

(54) SOLID BOWL SCREW CENTRIFUGE COMPRISING A PEELING DISK, AND METHOD FOR THE OPERATION THEREOF

(75) Inventors: Wilhelm Ostkamp, Oelde (DE); Franz Kramer, Ennigerloh (DE); Wolf-Dietrich Herberg, Witten (DE)

(73) Assignee: Westfalia Separator AG, Oelde (DE)

( * ) Notice: Subject to any disclaimer, the term of this patent is extended or adjusted under 35 U.S.C. 154(b) by 0 days.

(21) Appl. No.: 10/513,927

(22) PCT Filed: May 27, 2003

(86) PCT No.: PCT/EP03/05530

§ 371 (c)(1),
(2), (4) Date: Nov. 10, 2004

(87) PCT Pub. No.: WO03/099446

PCT Pub. Date: Dec. 4, 2003

(65) Prior Publication Data

US 2005/0227848 A1 Oct. 13, 2005

(30) Foreign Application Priority Data

May 29, 2002 (DE) ..... 102 23 802

(51) Int. Cl.
*B04B 1/20* (2006.01)
*B04B 11/08* (2006.01)

(52) U.S. Cl. ..... 494/27; 494/37; 494/53; 494/56

(58) Field of Classification Search ..... 494/23–30, 494/37, 50–57; 210/380.1, 380.3
See application file for complete search history.

(56) References Cited

U.S. PATENT DOCUMENTS

| | | | | |
|---|---|---|---|---|
| 3,279,687 | A * | 10/1966 | Amero | 494/37 |
| 3,279,688 | A * | 10/1966 | Cook | 494/10 |
| 3,321,131 | A * | 5/1967 | Cook | 494/10 |
| 3,447,742 | A | 6/1969 | Eriksson | |
| 3,462,076 | A | 8/1969 | Steinacker | |
| 3,568,919 | A | 3/1971 | Nielsen | |
| 3,784,091 | A * | 1/1974 | Hiller | 494/27 |
| 3,795,361 | A | 3/1974 | Lee | |
| 3,885,734 | A | 5/1975 | Lee | |
| 3,968,929 | A * | 7/1976 | Olesen | 494/22 |
| 4,210,275 | A | 7/1980 | Zettier | |
| 4,211,361 | A | 7/1980 | Baram | |

(Continued)

FOREIGN PATENT DOCUMENTS

DE 653 294 11/1937

(Continued)

OTHER PUBLICATIONS

Nr. 1 952 785, "Selbstreinigende Schleudertrommel mit außenliegendem Kolbenschieber," Dec. 29, 1966.

*Primary Examiner*—Charles E. Cooley
(74) *Attorney, Agent, or Firm*—Barnes & Thornburg LLP

(57) ABSTRACT

A solid bowl screw centrifuge includes a centrifuging chamber and a rotatable drum having a horizontal axis of rotation. The rotatable drum surrounds the centrifuging chamber. Also included is a rotatable screw arranged in the rotatable drum, at least one solids discharge, at least one liquid discharge duct and a peeling disk via which liquids are discharged through the liquid discharge duct. Further included is a blocking chamber connected to an output side of the peeling disk.

18 Claims, 2 Drawing Sheets

U.S. PATENT DOCUMENTS

| | | | | | |
|---|---|---|---|---|---|
| 4,245,777 | A | | 1/1981 | Lavanchy | |
| 4,322,362 | A | | 3/1982 | Kaplan | |
| 4,334,647 | A | * | 6/1982 | Taylor | 494/37 |
| 4,406,652 | A | * | 9/1983 | Nielsen | 494/56 |
| 4,451,247 | A | * | 5/1984 | Ostkamp et al. | 494/52 |
| 4,464,162 | A | * | 8/1984 | Cummings | 494/53 |
| 4,505,698 | A | | 3/1985 | Bröker | |
| 4,505,700 | A | | 3/1985 | Zettier | |
| 4,533,344 | A | | 8/1985 | Gunnewig | |
| 4,566,873 | A | * | 1/1986 | Toda | 494/53 |
| 4,615,690 | A | * | 10/1986 | Ecker | 494/56 |
| 4,708,711 | A | | 11/1987 | Scherer | |
| 4,898,571 | A | * | 2/1990 | Epper et al. | 494/26 |
| 5,156,751 | A | | 10/1992 | Miller | |
| 5,167,609 | A | | 12/1992 | Graw et al. | |
| 5,171,205 | A | * | 12/1992 | Monkenbusch | 494/10 |
| 5,252,209 | A | | 10/1993 | Retter | |
| 5,306,225 | A | | 4/1994 | Miyano et al. | |
| 5,474,515 | A | | 12/1995 | Epper et al. | |
| 5,542,903 | A | * | 8/1996 | Nishida et al. | 494/53 |
| 5,593,377 | A | | 1/1997 | Figgener et al. | |
| 5,685,819 | A | * | 11/1997 | Nishida et al. | 494/53 |
| 5,800,332 | A | * | 9/1998 | Hensley | 494/53 |
| 5,885,202 | A | * | 3/1999 | Ostkamp | 494/25 |
| 6,015,375 | A | | 1/2000 | Moss | |
| 6,390,964 | B1 | | 5/2002 | Mackel | |
| 6,572,524 | B1 | | 6/2003 | Cadwell | |
| 6,648,809 | B1 | | 11/2003 | Mackel et al. | |
| 6,749,552 | B1 | | 6/2004 | Figgener et al. | |
| 2004/0185999 | A1 | * | 9/2004 | Beyer et al. | 494/53 |
| 2005/0227848 | A1 | * | 10/2005 | Ostkamp et al. | 494/53 |

FOREIGN PATENT DOCUMENTS

| | | | | |
|---|---|---|---|---|
| DE | 657 473 | | | 3/1938 |
| DE | 1 532 678 | | | 3/1970 |
| DE | 1 908 949 | | | 9/1970 |
| DE | 2246113 | | * | 5/1973 |
| DE | 2 344 507 | | | 3/1974 |
| DE | 27 37 463 | | | 2/1979 |
| DE | 33 05 216 | | | 8/1984 |
| DE | 33 08 505 | | | 11/1984 |
| DE | 35 45 515 | | | 5/1987 |
| DE | 36 38 782 | | | 5/1988 |
| DE | 3728901 | C1 | * | 11/1988 |
| DE | 3822983 | A1 | * | 1/1990 |
| DE | 3833523 | A1 | * | 4/1990 |
| DE | 39 04 151 | | | 8/1990 |
| DE | 40 14 552 | | | 7/1991 |
| DE | 4132044 | C1 | * | 11/1992 |
| DE | 43 20 265 | | | 12/1994 |
| DE | 4339582 | C1 | * | 5/1995 |
| DE | 195 00 600 | | | 2/1996 |
| DE | 195 37 562 | | | 4/1997 |
| DE | 196 31 226 | | | 2/1998 |
| DE | 198 30 653 | | | 11/1999 |
| DE | 199 22 237 | | | 7/2000 |
| DE | 199 52 785 | | | 5/2001 |
| EP | 0640398 | A2 | * | 3/1995 |
| EP | 0 785 029 | | | 7/1997 |
| EP | 1 232 794 | | | 8/2002 |
| GB | 479007 | | | 1/1938 |
| JP | 58-199055 | | * | 11/1983 |
| JP | 2-71859 | | * | 3/1990 |
| JP | 4-222651 | | * | 8/1992 |
| JP | 10-151369 | | | 6/1998 |
| WO | WO 01/32314 | | | 2/2001 |
| WO | 03/099446 | A1 | * | 12/2003 |

* cited by examiner

SOLID BOWL SCREW CENTRIFUGE COMPRISING A PEELING DISK, AND METHOD FOR THE OPERATION THEREOF

BACKGROUND

The present disclosure relates to a solid bowl screw centrifuge that includes a centrifuging chamber and a rotatable drum having a horizontal axis of rotation. The rotatable drum surrounds the centrifuging chamber. Also included is a rotatable screw arranged in the rotatable drum, at least one solids discharge, at least one liquid discharge duct and a peeling disk via which liquids are discharged through the liquid discharge duct. Further included is a blocking chamber connected to an output side of the peeling disk. The present disclosure further relates to a method for operation of the centrifuge.

A solid bowl screw centrifuge of the above-mentioned type is shown by German Patent Document DE 195 00 600 C1. German Patent Document DE 40 14 552 C1 shows a separator with a vertical axis of rotation having a peeling disk and a blocking disk between which a gas can be fed to prevent a degassing of solvents.

The solid bowl screw centrifuge disclosed in German Patent Document DE 43 20 265 A1 is equipped with a weir on the liquid outlet side, which weir has a passage. An orifice plate, which is stationary relative to the drum during its rotation, is assigned to the passage. By way of a threaded bush, this orifice plate is axially displaceable. By rotating the threaded bush, the distance between the weir and the orifice plate can be changed. The resulting change of the outflow cross-section causes a change of the liquid level in the centrifugal drum, so that a continuous adjustment of this liquid level can be achieved by displacing the orifice plate.

From German Patent Document DE 39 04 151 A1, a diaphragm plate situated on the screw is known. Nozzles on the outer circumference are used for minimizing the energy consumption. A processing of sensitive products with a gas-tight sealing-off with respect to the environment cannot be achieved by this construction.

From German Patent Document DE 198 30 653 C1 of the above-mentioned type, it is known to implement the liquid discharge of an open solid bowl screw centrifuge by of a peeling disk which is followed by a labyrinth seal, in order to return product droplets to the peeling disk. According to this construction, no sealing-off is required with respect to the exterior space. However, solid bowl screw centrifuges with peeling disks in which the product space is sealed off toward the outside are also in demand. The present disclosure addresses such a solid bowl screw centrifuge by simple constructive devices.

SUMMARY

The present disclosure relates to a sold bowl screw centrifuge that includes a centrifuging chamber and a rotatable drum having a horizontal axis of rotation. The rotatable drum surrounds the centrifuging chamber. Also included is a rotatable screw arranged in the rotatable drum, at least one solids discharge, at least one liquid discharge duct, and a peeling disk via which liquids are discharged through the liquid discharge duct. A blocking chamber is connected to an output side of the peeling disk and includes an annulus having a first siphon disk arranged therein. The blocking chamber is a hydrohermetic blocking chamber to seal off the centrifuging chamber from its surroundings via a sealing liquid that is independent of material to be centrifuged. A feed line is assigned to the blocking chamber to feed the sealing liquid. The rotatable screw includes a second siphon disk extending from the screw radially to the outside into the centrifuging chamber.

The present disclosure also relates to a method of operating the solid bowl screw centrifuge noted immediately above. The method steps include, turning on the centrifuge and feeding the sealing liquid that is independent of the material to be centrifuged through the feed line into the blocking chamber to seal off the centrifuging chamber from its surroundings.

The blocking chamber with the sealing liquid supply, which may be in combination with two blocking or siphon disks, permits a reliable sealing-off of the centrifuging chamber with respect to the surrounding atmosphere. In contrast, in German Patent Document DE 198 30 653 C1 of the above-mentioned type, the product can still come in contact with the surrounding atmosphere because of the labyrinth seal.

Blocking chambers are also known per se from centrifuges with a vertical axis of rotation, a separate sealing liquid also being guided into these blocking chambers (German Patent Document DE 196 31 226). Blocking chambers in the case of such separators are also known from German Patent Document DE 657 473. However, it has not been considered and apparently has not been seen as being beneficial to implement a blocking chamber in the case of centrifuges with a horizontal axis of rotation which blocking chamber is acted upon by a separate sealing liquid independent of the centrifuge material.

When a pressure is built up in the interior of the decanter or of the solid bowl screw centrifuge, a gas (such as CO2) dissolved in the centrifuge product (for example, a beverage) would under certain circumstances partially escape from the solid bowl screw centrifuge without a blocking chamber arrangement with two siphon disks and the sealing liquid feed. This is prevented by the centrifuge of the present disclosure.

By the blocking or siphon disk in the blocking chamber, sufficient pressure can be built up in a simple manner, so that a gas, such as CO2, is kept as a liquid. By varying the diameter of the blocking and siphon disk, the pressure in the blocking chamber can be varied, which amounts to up to 4 bar, and more particularly to 0.5 to 2.5 bar. The pressure influences the type of the conveyance of the solids and/or their consistency.

The feed line and a discharge bore lead into an annulus of the blocking chamber and permit the continuous feeding and discharging of the sealing liquid into the blocking chamber and out of the blocking chamber. As a result, a continuous cleaning of the blocking chamber can be implemented in a much simpler manner than in German Patent Document DE 196 31 226 A1. As a result, the forming of deposits in the blocking chamber of the present disclosure can be effectively prevented. The centrifuge of the present disclosure therefore also meets high hygienic requirements.

Since the liquid discharge takes place by a peeling disk, which is followed in a direct manner by the blocking chamber, a dissolved gas, such as CO2, can be kept at least largely as a liquid to be discharged or to be processed. This considerably simplifies the processing of products, such as beer.

The blocking chamber as well as the peeling disk are arranged on the drum side or toward the drum with respect to the main bearing or bearings of the drum. This permits a simple development of the construction. This also results not only in a durable sealing-off with respect to the surrounding atmosphere but, under certain circumstances, also in a sealing-off with respect to product contamination by oil mist of a liquid-side main bearing.

Other aspects of the present disclosure will become apparent from the following descriptions when considered in conjunction with the accompanying drawings.

DETAILED DESCRIPTION

Figure 1:
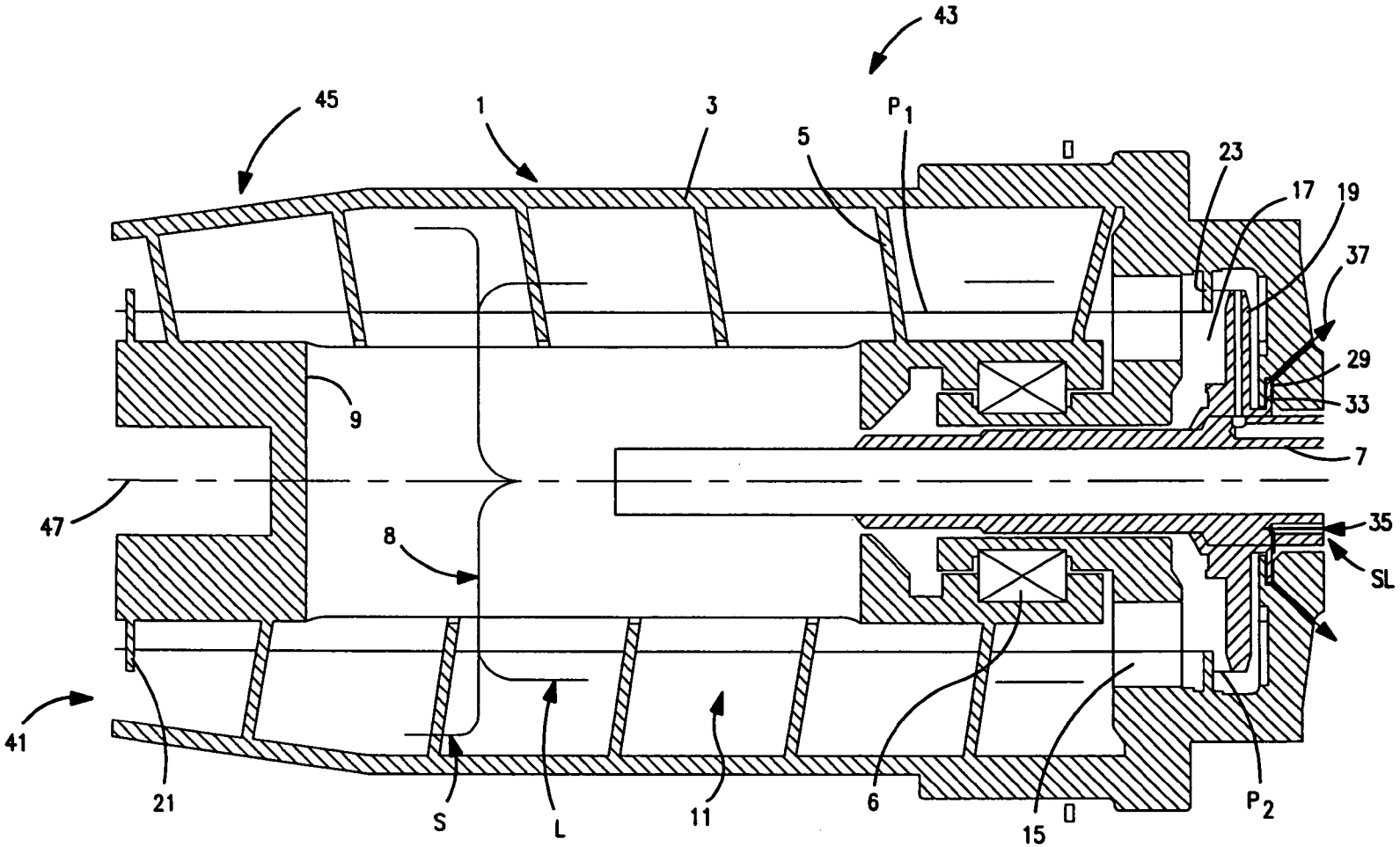
FIG. 1 is a sectional view of a solid bowl screw centrifuge, according to the present disclosure.

FIG. 1 illustrates a solid bowl screw centrifuge 1 with a rotatable drum 3 having a horizontal axis of rotation in which a rotatable screw 5 is arranged. The drum 3 and the rotatable screw 5 each include an essentially cylindrical section 43 and a conically tapering area or section 45.

An axially extending centric feed pipe 7 is used for feeding the centrifuge material 8 by way of a distributor 9, which is shown, for example, perpendicular with respect to the feed pipe 7. The centrifuge material 8 is then fed into a centrifugal or centrifuging chamber 11 between the rotatable screw 5 and the drum 3.

When, for example, a sludgy pulp is fed into the centrifuge 1, solid particles S are deposited on or near a drum wall. A liquid phase L develops farther toward the inside of the drum 3.

The screw 5, disposed by bearing 6, rotates at a slightly lower or higher speed than the drum 3 and conveys centrifuged solids S toward the conically tapering section 45 and out of the drum 3 via a solids discharge, shown, for example, by arrow and numerical designation 41.

In contrast, the liquid phase L flows to a larger drum diameter at a rearward end of the cylindrical section 43 of the drum 3 and is guided there through a weir 15 into a peeling disk chamber 17 which axially adjoins the centrifuging chamber 11. The peeling disk chamber 17 has a diameter which is smaller in comparison to a diameter of the centrifuging chamber 11.

Figure 2:
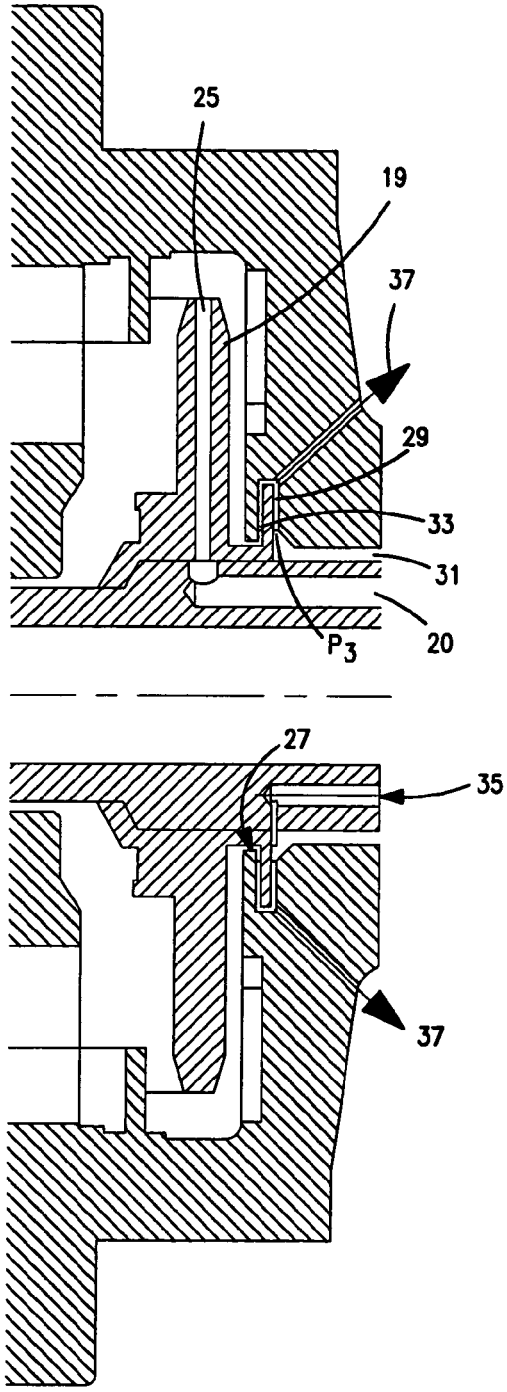
FIG. 2 is an enlargement of a portion of FIG. 1.

A peeling disk 19, for discharging the liquid phase L, is arranged in the peeling disk chamber 17 (see also FIG. 2), which is adjoined by a discharge duct 20 discharging the liquid phase L from the drum 3. The peeling disk 19 is arranged directly on the feed pipe 7 which is stationary during an operation of the centrifuge 1. A sealed-off gap-free arrangement is implemented between the peeling disk 19 and the feed pipe 7.

In the conically tapering area 45 of the drum 3, the screw 1, in front of the solids discharge 41, has a siphon disk 21 which extends from the screw 5 radially toward the outside into the centrifuging chamber 11 and the siphon disk 21 is immersed into a liquid level $P_1$.

As a result of the immersion, an interior area or centrifuging area in the centrifuging chamber 11, shown to the right of the siphon disk 21 in FIG. 1, is hermetically sealed off with respect to the surroundings or the surrounding atmosphere. It would also be conceivable to arrange additional siphon disks in the conically tapering area 45 of the drum 3 in order to influence the consistency of the centrifuged solids 5 in this manner (not shown here).

In the peeling disk chamber 17, a ring disk or shoulder 23 is arranged on the side of the peeling disk 19 pointing to the centrifuging chamber 11, which ring shoulder 23 extends radially from the inner circumference of the peeling disk chamber 17 toward the inside of the centrifuge 1.

The liquid level $P_1$ forms between the siphon disk 21 and the ring shoulder 23 during the operation of the centrifuge 1 because the siphon disk 21 and the ring shoulder 23 overlap in the radial direction or because the siphon disk 21 and ring shoulder 23 are correspondingly adapted to one another.

In contrast, between the ring shoulder 23 and the peeling disk 19, a liquid level $P_2$ extends to an inlet opening 25 (see FIG. 2) of the peeling disk 19. The liquid level $P_2$ can be varied by at least slightly throttling the peeling disk 19.

On a side of the peeling disk 19 facing away from the ring shoulder 23 the peeling disk chamber 17 extends radially toward the inside close to the feed pipe 7 or to a diameter smaller than the diameter of the screw 5, and leads into an axial passage 27. Axial passage 27 is adjoined in an axial direction by an annulus 29, which acts as a blocking chamber, also identified with numerical designation 29. Blocking chamber 29 leads into an axial discharge duct 31 for sealing liquid SL on the outer circumference of the feed pipe 7. The inside diameter of the discharge duct 31 for the sealing liquid SL is smaller than the inside diameter of the passage 27, so that sealing liquid SL overflowing from the blocking chamber 29 flows out through the discharge duct 31.

In the blocking chamber or annulus 29, another siphon or blocking disk 33 is stationarily arranged on an inner circumference and extends from an inside of the drum 3 radially to an outside of the drum 3 into the blocking chamber 29.

A feed line 35 arranged parallel to the feed pipe 7 on its outer circumference leads into the centrifuge 1 from the outside and permits a direct feeding of the sealing liquid SL, such as water, which is independent of the centrifuge material 8, into the blocking chamber 29.

A discharge bore 37 is on a circumference of the blocking chamber 29 at an acute angle with respect to an axis of rotation 47 of the drum 3 and extends radially to the outside out of the drum 3 permitting the continuous discharge of sealing liquid SL from the annulus 29, which causes a cleaning of the blocking chamber 29.

During an operation of the centrifuge 1, that is, during rotations of the drum 3 and the screw 5 a liquid level $P_3$ of the sealing liquid SL forms in the block chamber 29, which liquid level $P_3$ seals off the interior of the drum 3 against the surrounding atmosphere when the feeding amount of sealing liquid SL into the blocking chamber 29 is larger than the discharge amount, which is adjusted by a dimensioning of the discharge bore 37. Excess water which does not flow off through the discharge bore 37 flows off through the discharge duct 31.

By siphon disk 33 in the blocking chamber 29, however, a sufficient pressure can be built up so that gas is kept as a liquid. By varying the diameter of the blocking and siphon disk 33, the pressure in the blocking chamber 29 can be varied. The pressure influences the type of the conveyance of the solids 5 and/or their consistency.

Although the present disclosure has been described and illustrated in detail, it is to be clearly understood that this is done by way of illustration and example only and is not to be taken by way of limitation. The spirit and scope of the present disclosure are to be limited only by the terms of the appended claims.

We claim:

1. A solid bowl screw centrifuge, comprising:

a centrifuging chamber;

a rotatable drum having a horizontal axis of rotation, the rotatable drum surrounding the centrifuging chamber;

a rotatable screw arranged in the rotatable drum;

at least one solids discharge;

at least one liquid discharge duct;

a peeling disk via which liquids are discharged through the liquid discharge duct;

a blocking chamber connected to an output side of the peeling disk, the blocking chamber including an annulus having a first siphon disk arranged therein, the blocking chamber being a hydrohermetic blocking chamber to seal off the centrifuging chamber from its surroundings via a sealing liquid that is independent of material to be centrifuged;

a feed line assigned to the blocking chamber to feed the sealing liquid; and wherein the rotatable screw includes a second siphon disk extending from the screw radially to the outside into the centrifuging chamber.

2. The solid bowl screw centrifuge according to claim 1, wherein the blocking chamber is connected directly behind the peeling disk.

3. The solid bowl screw centrifuge according to claim 1, wherein the second siphon disk is arranged on the screw in front of the solids discharge.

4. The solid bowl screw centrifuge according to claim 3, wherein the second siphon disk is arranged on the screw in a conically tapering section of the rotatable drum.

5. The solid bowl screw centrifuge according to claim 1, further including a feed pipe and a discharge bore leading into the annulus and permitting a continuous feeding and discharging of the sealing liquid into and out of the blocking chamber.

6. The solid bowl screw centrifuge according to claim 1, wherein the rotatable drum and the rotatable screw each have an essentially cylindrical section and a tapering section, the centrifuge further including a peeling disk chamber adjoining the cylindrical section, the peeling disk chamber having a diameter that is smaller than a diameter of the centrifuging chamber, and in which peeling disk chamber the peeling disk is situated.

7. The solid bowl screw centrifuge according to claim 6, wherein a ring shoulder is arranged on an inner circumference of the peeling disk chamber.

8. The solid bowl screw centrifuge according to claim 7, wherein the peeling disk chamber, on a side of the peeling disk facing away from the ring shoulder, extends radially to the inside of the rotatable drum to a diameter which is smaller than the diameter of the screw, and the peeling disk chamber leads into a passage which is adjoined in an axial direction by the annulus leading into an axial discharge duct for the sealing liquid, the inside diameter of discharge duct being smaller than that of the passage, so that sealing liquid overflowing from the blocking chamber can be discharged through the discharge duct.

9. The solid bowl screw centrifuge according to claim 7, wherein the first siphon disk and the ring shoulder are mutually coordinated such that, during an operation of the centrifuge, a liquid level $P_1$ forms between them.

10. The solid bowl screw centrifuge according to claim 1, wherein the first siphon disk is one of attached and molded perpendicularly to an inner circumference of the blocking chamber having the annulus, which first siphon disk extends radially from the inside toward the outside of the drum and into the annulus.

11. The solid bowl screw centrifuge according to claim 1, wherein the feed line is arranged parallel to and on an outside circumference of a feed pipe for feeding material to be centrifuged.

12. The solid bowl screw centrifuge according to claim 11, wherein the peeling disk is arranged in a sealed-off manner on the feed pipe which is stationary during an operation of the centrifuge.

13. The solid bowl screw centrifuge according to claim 1, wherein a discharge bore leads from an outer circumference of the annulus at an acute angle with respect to an axis of rotation of the drum and radially to the outside of the drum.

14. A method of operating a solid bowl screw centrifuge, the solid bowl centrifuge including a centrifuging chamber, a rotatable drum surrounding the centrifuging chamber and having a horizontal axis of rotation, a rotatable screw arranged in the rotatable drum, at least one solids discharge, at least one liquid discharge duct, a peeling disk via which liquids are discharged through the liquid discharge duct, a blocking chamber connected to an output side of the peeling disk including an annulus having a first siphon disk arranged therein, a feed line assigned to the blocking chamber to feed the sealing liquid, and the rotatable screw includes a second siphon disk extending from the screw radially to the outside into the centrifuging chamber, the method steps comprising, turning on the centrifuge; and feeding a sealing liquid that is independent of the material to be centrifuged through the feed line into the blocking chamber to seal off the centrifuging chamber from its surroundings.

15. The method according to claim 14, further including the step of discharging the sealing liquid, thereby effecting a continuous cleaning of the blocking chamber.

16. The method according to claim 14, further including the step of adjusting pressure in the blocking chamber by varying a diameter of the first siphon disk.

17. The method according to claim 14, further including the step of providing a pressure in the centrifugal chamber of up to 4 bar.

18. The method according to claim 14, further including the step of providing a pressure in the blocking chamber of 0.5 to 2.5 bar.

* * * * *